US006467785B2

(12) United States Patent
Toppses

(10) Patent No.: US 6,467,785 B2
(45) **Date of Patent: *Oct. 22, 2002**

(54) WHEELCHAIR WITH ADJUSTABLE SEAT

(76) Inventor: Tony Toppses, Dutch Village Apt. 21-1L Hague House, Menands, NY (US) 12204

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/119,251

(22) Filed: Jul. 20, 1998

(65) Prior Publication Data

US 2001/0002081 A1 May 31, 2001

(51) Int. Cl.[7] ..... A61G 5/10; A47C 3/32

(52) U.S. Cl. ..... 280/250.1; 280/304.1; 297/338

(58) Field of Search ..... 280/250.1, 304.1; 414/921; 297/338, 344.12, 378.12, 339, 344.77, 323.19

(56) References Cited

U.S. PATENT DOCUMENTS

| | | | | | |
|---|---|---|---|---|---|
| 1,964,217 | A | * | 6/1934 | Savoy | 297/339 |
| 2,596,055 | A | * | 5/1952 | Thomas | 297/338 |
| 2,603,372 | A | * | 7/1952 | Ketchpel | 414/656 |
| 2,796,922 | A | * | 6/1957 | Young | 297/338 |
| 2,850,075 | A | * | 9/1958 | Wilson | 297/339 |
| 4,266,305 | A | | 5/1981 | Kavaloski et al. | |
| 4,278,387 | A | | 7/1981 | Seguela et al. | |
| 4,354,791 | A | | 10/1982 | Antonellis | |
| 4,405,142 | A | | 9/1983 | Whetstine | |
| 4,453,732 | A | | 6/1984 | Assanah et al. | |
| 4,499,970 | A | * | 2/1985 | Hussey | 414/921 |
| 4,527,829 | A | | 7/1985 | Fanslau et al. | |
| 4,542,918 | A | | 9/1985 | Singleton | |

(List continued on next page.)

OTHER PUBLICATIONS

FOR KIDS, Permobil Power, Jurasic Adventure, 4 pages.

CIRCUS PERMOBIL Proudly Presenting The Greates Show On Earth, 4 pages.

CHAIRMAN ROBO For Kids, Permobil, INDO. ROBO–US0997, 2 pages.

(List continued on next page.)

*Primary Examiner*—Brian L. Johnson
*Assistant Examiner*—Hau Phan
(74) *Attorney, Agent, or Firm*—Schmeiser, Olsen & Watts

(57) ABSTRACT

A wheelchair has an adjustable seat that can be raised and lowered between a normal wheelchair operating height and ground level for enabling a wheelchair-dependent person to gain access to the seat from ground level and independently raise himself or herself from the ground level to the normal operating height. The seat can be further raised above the normal operating height to a higher level for improved reaching capability. In one embodiment, an elongate shaft is connected to the seat for rotation about its longitudinal axis. A plurality of cables have first ends that are connected to a wheelchair supporting frame and second ends that are connected to the elongate shaft. Rotation of the shaft about its longitudinal axis in one direction causes the cables to wind around the shaft to thereby raise the seat. Rotation of the shaft in the opposite direction causes the cables to unwind from the shaft to thereby lower the seat. In a further embodiment, the wheelchair supporting frame includes a lower frame portion and an upper frame portion that is adjustable in height with respect to the lower frame portion. The seat is connected to the upper frame portion for adjusting the height of the seat relative to the lower frame portion between the normal operating height and a level above the normal operating height. Preferably, the upper frame portion is telescopically received in the lower frame portion. A locking mechanism can be provided for locking the upper and lower frame portions together at any number of seat heights.

19 Claims, 3 Drawing Sheets

U.S. PATENT DOCUMENTS

| | | | | | |
|---|---|---|---|---|---|
| 4,555,121 | A | | 11/1985 | Lockard et al. | |
| 4,926,973 | A | * | 5/1990 | Smith | 414/921 |
| 4,993,736 | A | | 2/1991 | Garman et al. | |
| 5,058,221 | A | | 10/1991 | Abraham | |
| 5,060,960 | A | | 10/1991 | Branscumb et al. | |
| 5,131,503 | A | * | 7/1992 | Billington, III et al. | 187/240 |
| 5,333,333 | A | * | 8/1994 | Mah | 280/250.1 |
| 5,380,034 | A | | 1/1995 | Wilson | |
| 5,427,438 | A | * | 6/1995 | Fochs | 297/344.18 |
| 5,520,403 | A | * | 5/1996 | Bergstrom et al. | 280/250.1 |
| 5,651,149 | A | | 7/1997 | Garman | |
| 5,669,086 | A | * | 9/1997 | Garman | 280/304.1 |
| 5,669,620 | A | | 9/1997 | Robbins | |
| 5,695,248 | A | * | 12/1997 | Bell | 297/344.17 |
| 5,758,926 | A | * | 6/1998 | Wilkie et al. | 297/423.19 |
| 5,816,655 | A | * | 10/1998 | Hoegh | 297/338 |
| 5,921,628 | A | * | 7/1999 | Glockl | 297/338 |

OTHER PUBLICATIONS

CHAIRMAN MINI STANDER For Kids, Permobil, INDO. CMS–US0997, 2 pages.

CHAIRMAN MINIFLEX For Kids, Permobil, INDO. CMF–US0997, 2 pages.

CHAIRMAN CORPUS, Permobil, IDNO. CC–US0997, 2 pages.

CHAIRMAN STANDER, Permobil, IDNO. CST–US0997, 2 pages.

CHAIRMAN MPS, Multi Positioning System, Permobil, IDNO. CMPS–US0997, 2 pages.

DRIVELINK—For Chairman Alternative Driving System, Permobil, IDNO: DL–US0997, 2 pages.

* cited by examiner

WHEELCHAIR WITH ADJUSTABLE SEAT

BACKGROUND OF THE INVENTION

1. Field of the Invention

This invention relates to wheelchairs, and more particularly to independent access to wheelchairs from ground level as well as wheelchairs with adjustable seat heights.

2. Description of the Related Art

Wheelchair users today can accomplish incredible feats, such as participating in marathons, skiing, sky diving, scuba diving, etc. Normally, wheelchairs do not stop their occupants from living full and rich lives. Yet, one major problem faced by individuals in wheelchairs occurs when the wheelchair tips and ejects its occupant. This often occurs when the user reaches and leans too far forward or to one side. It may also occur outdoors on uneven terrain or when encountering all sorts of natural objects or obstacles, or even when attempting to transfer from the wheelchair to a bed or other location. Unless the individual has great upper body strength, he or she cannot climb back into the wheelchair independently, and sometimes must wait for long periods of time before help arrives. This situation can lead to potentially serious consequences.

None of the prior art addresses the need for getting back into the wheelchair should a mishap occur. Moreover, none of the prior art addresses the situation where the wheelchair user desires to be lowered from the normal operating height to the floor or ground. None of the wheelchairs in the prior art is capable of permitting the wheelchair user to safely lower himself or herself to the ground without tipping the chair and falling or using some type of assistance. Although some wheelchairs have been produced for pediatric applications or highly specialized situations that allow an individual to be lowered to the floor, the manufacturer limits their use to occupants no heavier than 80 lbs. Furthermore, they tend to be very large and bulky, cannot be used on a regular basis, and cannot be maneuvered in tight situations.

Another challenge for the wheelchair user is that it is difficult to reach objects higher than arm's reach due to the restricted wheelchair seat height. Even if one employs a device such as a reacher, the lack of fine dexterity and tactile feedback is a problem. Moreover, the problems associated with a physically disabled person transferring to or from a wheelchair have long been recognized. The difficulty a physically challenged person has in moving from a wheelchair to another location, such as the passenger seat of a vehicle, is augmented by the differences in seat heights of the wheelchair and passenger seat or other support. In an attempt to overcome the problems associated with differences in seat heights, several solutions have been proposed.

U.S. Pat. No. 5,669,620 issued to Robbins discloses a laterally and vertically movable wheelchair seat for allowing a patient or physically challenged individual to be transported from the wheelchair to a fixed seat frame. The lateral and vertical movement is achieved by a jack mechanism which supports the seat, and is powered by a hand crank or electric motor, which raises the seat from a normal operating height.

U.S. Pat. No. 5,060,960 issued to Branscumb, et al. discloses a wheelchair comprising a foot-actuated hydraulic pump, similar to a barber's chair, below the seat panel which allows an attendant to raise the seat to the desired level from a normal operating height.

U.S. Pat. No. 5,520,403 issued to Bergstrom, et al., discloses a wheelchair which allows a patient to be laterally transferred from the wheelchair to a desired location, such as a bed. The seat is a belt-like structure that laterally transports the user via a manual crank and may be adjusted upwardly from a normal operating height by turning a crank lead screw. The arms of the wheelchair articulate rearward and a transfer board extends from the seat to the bed for ease and safety of transportation.

SUMMARY OF THE INVENTION

These and other problems associated with the prior art are overcome by the provision of a wheelchair having a seat that can be adjusted between ground level and a normal wheelchair operating height, and between a normal operating height and an upper level above the normal operating height.

According to the invention, a wheelchair has a supporting frame with opposite sides, two or more wheels attached to the frame, and a seat operationally connected via adjusting means to the supporting frame between the opposite sides. The adjusting means are connected between the seat and supporting frame for adjusting the height of the seat relative to the supporting frame. This adjustment can range from a normal operating height associated with normal wheelchair operation and ground level to an upper level above the normal operating height. In this manner, a wheelchair occupant can be raised anywhere from the ground level to the normal operating height to the upper level by manipulation of the adjusting means. It should be noted that the wheelchair user may perform this manipulation independently and while in the wheelchair.

In one embodiment, the adjusting means comprises an elongate shaft connected to the seat for rotation about its longitudinal axis. At least one suspension cable has a first end connected to the supporting frame and a second end connected to the elongate shaft. Rotation of the shaft about its longitudinal axis in one direction causes the cable to wind around the shaft to thereby raise the seat, while rotation of the shaft in the opposite direction causes the cable to unwind from the shaft to thereby lower the seat.

Preferably, a first pair of cables have first ends connected to the opposite sides of the supporting frame at a forward portion thereof, and a second pair of cables have first ends connected to the opposite sides of the supporting frame at a rearward portion thereof. The second ends of the cables are preferably connected to opposite ends of the elongate shaft.

A torque arm can be telescopically or releasably connected to the shaft for rotating the shaft about its longitudinal axis in a power stroke direction. Preferably, a switch assembly is operatively connected to the shaft and seat. The switch assembly is movable to a first position that permits rotation of the shaft in the power stroke direction for winding the cables on the shaft and prevents rotation of the shaft in a direction opposite the power stroke direction to thereby prevent unwinding of the cable from the shaft. The switch assembly can also be moved to a second position for permitting free rotation of the shaft in the opposite direction for unwinding the cable from the shaft to thereby lowering or raising the seat relative to the neutral regular operational position.

A ratcheting mechanism can also be provided that is operatively connected between the shaft and torque arm for locking the shaft with the torque arm in the power stroke direction and permitting rotation of the torque arm with respect to the shaft when the torque arm is rotated in a recovery direction opposite the power stroke direction. During the power stroke with the switch assembly in the first position, the shaft is locked to the torque arm for rotation therewith and the shaft is unlocked from the seat. Likewise, the torque arm is unlocked from the shaft and the shaft is locked against rotation to the seat during the recovery stroke. In this manner, the seat can be ratcheted upward toward the normal seat height and locked against downward movement during the torque arm recovery stroke.

According to a further embodiment of the invention, the supporting frame includes a lower frame portion and an upper frame portion that is adjustable in height with respect to the lower frame portion. The seat is connected to the upper frame portion for adjusting the height of the seat relative to the lower frame portion between the normal operating height and a level above the normal operating height. Preferably, the upper frame portion is telescopically received in the lower frame portion. A locking mechanism can be provided for locking the upper and lower frame portions together at any number of seat heights.

DETAILED DESCRIPTION OF THE PREFERRED EMBODIMENT

Figure 1:
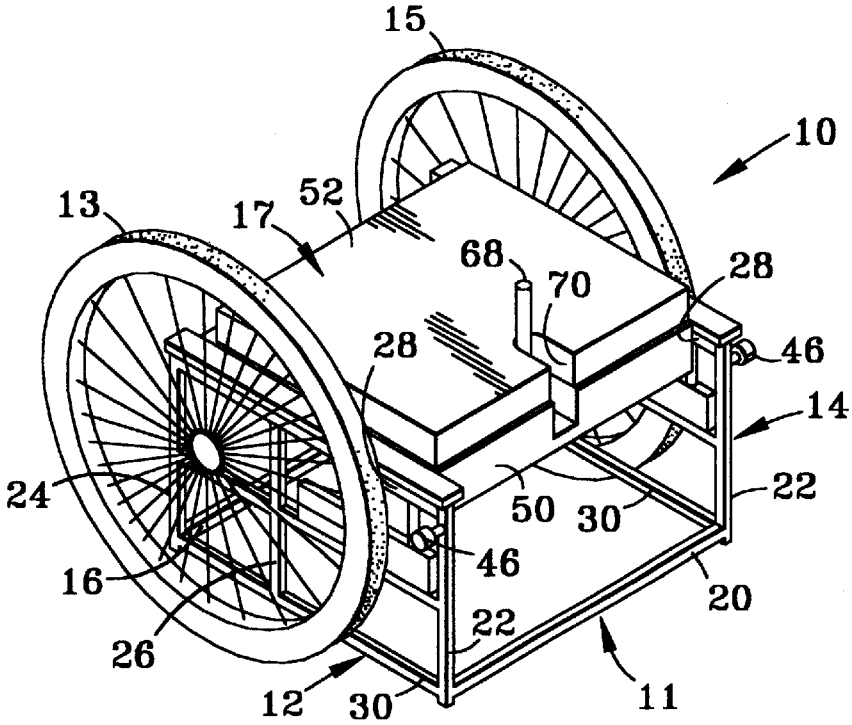
FIG. 1 is an orthogonal view of a portion of a wheelchair according to the present invention with an adjustable seat shown in a normal operating position.
Figure 2:
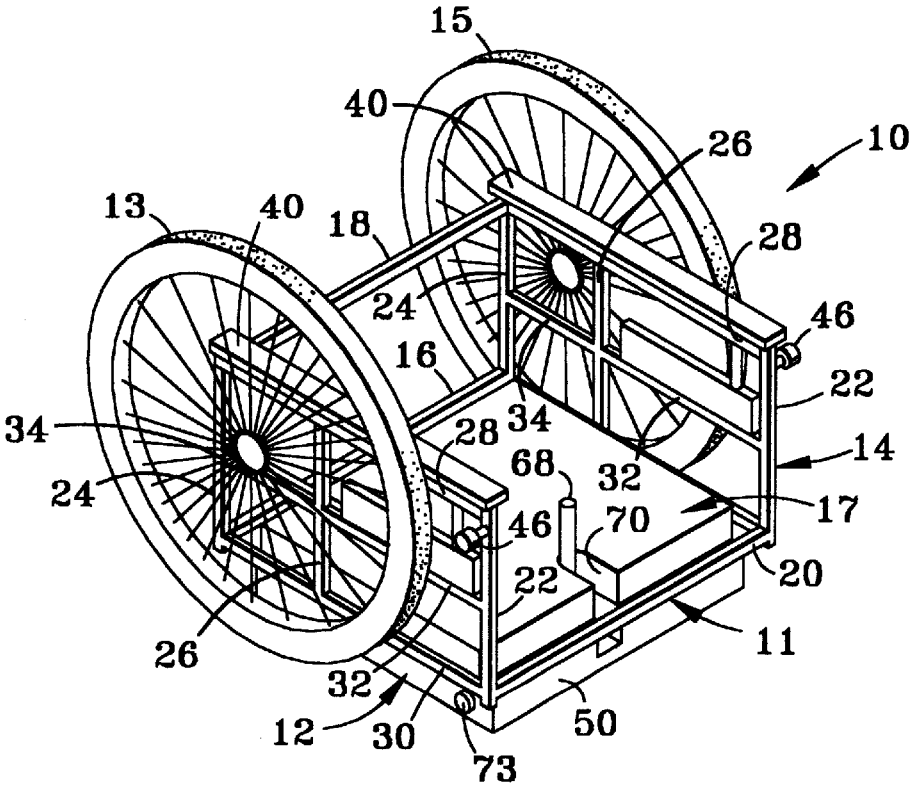
FIG. 2 is an orthogonal view similar to FIG. 1 showing the adjustable seat in a lowered position.

With reference now to the drawings, and to FIGS. 1 and 2 in particular, a wheelchair 10 according to the invention is shown, with the standard back rest, arm rests, front wheels, foot supports, and other parts removed for clarity. The wheelchair 10 comprises a framework 11, wheels 13, 15 attached to the framework 11 in a well-known manner, and an adjustable seat 17 connected to the framework, as will be described in greater detail below. Other parts of the wheelchair, such as the back rest, arm rests, etc., can be attached to the framework in a well-known manner.

The framework 11 is preferably of hollow tubular construction, and includes a lower frame portion having left side frame 12 connected to a right side frame 14 by a rear lower cross member 16, a rear upper cross member 18, and a front lower cross member 20. Each side frame 12, 14 includes a front upright 22, a rear upright 24, and a middle upright 26 extending generally vertically between an upper brace 28 and a lower brace 30. A front intermediate brace 32 extends between the uprights 22 and 26 and a rear intermediate brace 34 extends between the uprights 24 and 26.

Figure 5:
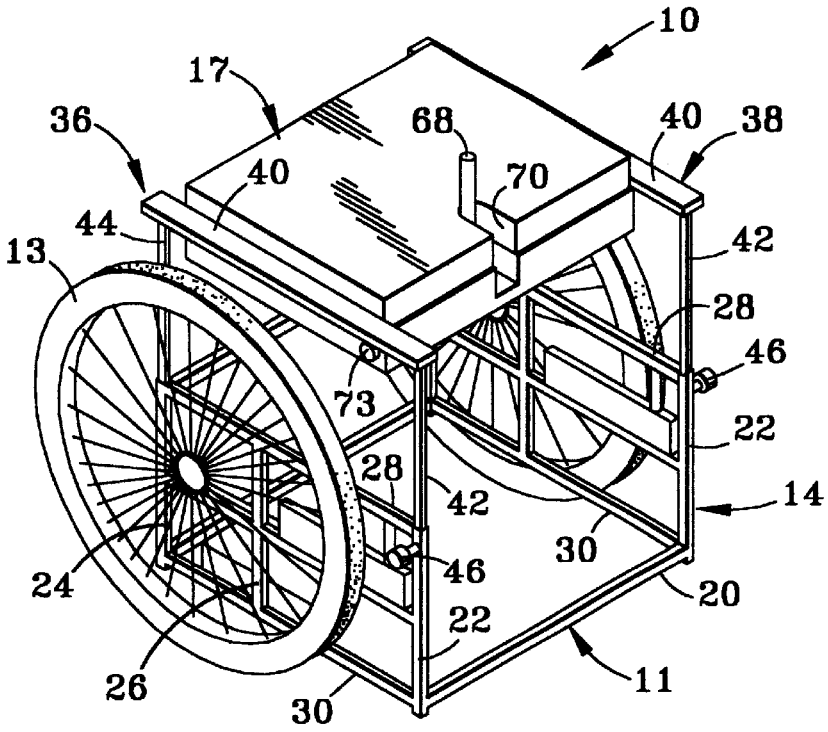
FIG. 5 is an orthogonal view similar to FIG. 1 showing the adjustable seat in a raised position.

With additional reference to FIG. 5, the framework 11 also includes an upper seat height adjustment assembly for adjusting the position of the seat between a normal wheelchair operating height and an upper height above the normal operating height. The seat height adjustment assembly includes an upper frame portion having an adjustable left side frame 36 and an adjustable right side frame 38. Each adjustable frame 36, 38 includes an upper brace member 40 extending generally horizontally between a front upright 42 and a rear upright 44. Preferably, the front and rear uprights 42 and 44 are telescopically received in the front and rear uprights 22 and 24, respectively, of the lower frame portion. If desired, one or more cross members (not shown) can extend between the rear uprights 44 for added stability. The front and rear uprights 22 and 24 preferably include apertures that, when mutually aligned, receive a pin from a locking mechanism 46 for securing the upper frame portion to the lower frame portion at one or more predetermined heights. The locking mechanisms 46 can be mounted to the uprights 22 through any well-known means, such as by screw threads or welding, and may have a spring-loaded pin for automatically engaging the apertures in the uprights 42 when the apertures are positioned in mutual alignment by moving the upper frame portion with respect to the lower frame portion. Alternatively, friction collars, locking cam elements, electric solenoids, or other well-known means can be used for releasably locking the upper frame portion with respect to the lower frame portion.

The seat 17 comprises a base 50 and a cushion 52 supported on the base. A releasable locking mechanism (not shown) can be attached to the base 50 and/or the upper frame portion for securing the base 50 to the upper frame portion. The releasable locking mechanism can be similar in construction to the locking pin assembly 46 previously described, such that locking between the base 50 and upper frame portion occurs when a pin on one of the base and upper frame portion is received in an aperture in the other of the base and upper frame portion. It is to be understood that other well-known releasable locking mechanisms can be used in place of a locking pin assembly.

Figure 3:
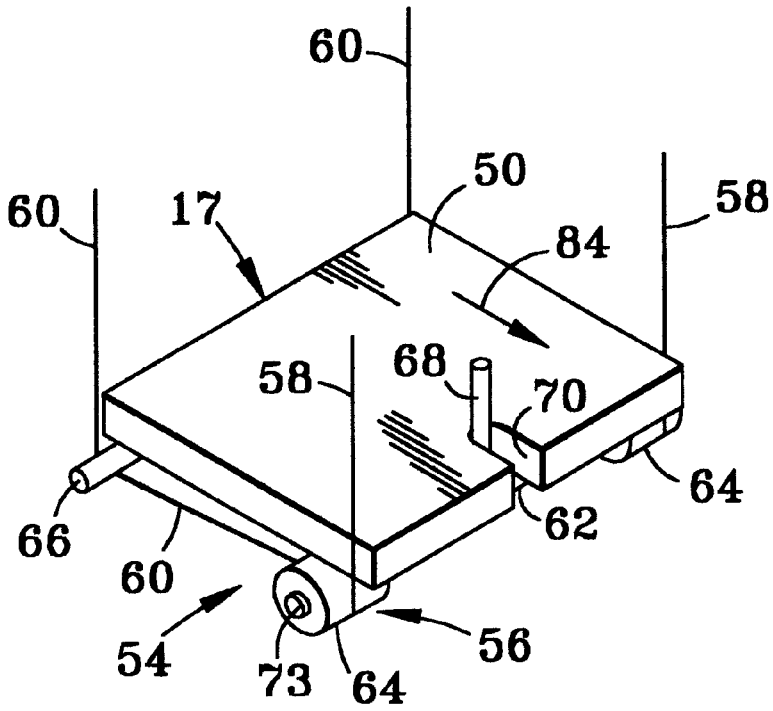
FIG. 3 is an orthogonal view of the adjustable seat and seat adjusting mechanism.
Figure 4:
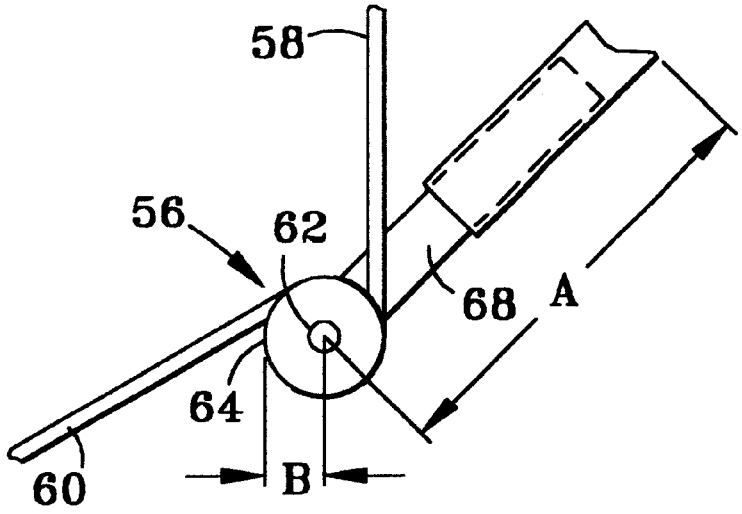
FIG. 4 is a side elevational view of a portion of the lifting mechanism.

With particular reference now to FIGS. 2, 3 and 4, a lower seat height adjustment assembly 54 for adjusting the elevation of the seat between a normal wheelchair operating height and ground level is illustrated. The lower adjustment assembly 54 includes a winch 56, preferably connected to the bottom of the base 50, a pair of front suspension cables or cords 58, and a pair of rear suspension cables or cords 60. The winch has an elongate shaft 62 that preferably extends the width of the base 50 and is mounted for rotation about its longitudinal center axis. A drum or pulley 64 is fixedly mounted to each end of the shaft 62. A lower end of each suspension cable is secured to the drum 64, such that rotation of the shaft 62 winds or unwinds the cables 58, 60 about the drums. Each cable 60 extends from its respective drum and wraps around a rod 66 that is mounted at opposite sides of the lower frame portion. The rod 66 serves as a bearing surface for the cable as the shaft 62 is rotated. Alternatively, the rod 66 can be replaced by a pulley or other similar arrangement. An upper end of each suspension cable is preferably connected to an upper end of the lower frame portion, but can alternatively be connected to the upper frame portion.

A torque arm 68 is mounted to the shaft 62 and extends through a slot 70 in the base 50 and cushion 52. Preferably, the torque arm is telescopic, but may alternatively be removable from the shaft 62 and stored when not in use. The torque arm also preferably includes an adjustable ratchet mechanism (86) similar to a ratchet wrench that couples the shaft to the torque arm for mutual rotation in a power stroke direction and uncouples the shaft from the torque arm for rotation of the torque arm in an opposite recovery direction independently of the shaft.

Figure 6:
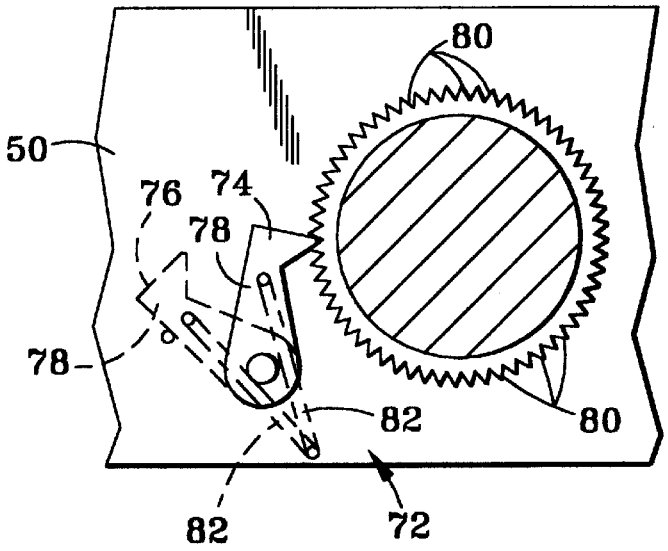
FIG. 6 is a side elevational view showing a locking assembly for use in raising and lowering the adjustable seat.

With additional reference to FIG. 6, a switch mechanism 72 is provided between the shaft 62 and base 50 that is movable between a first position 74 and a second position 76 (shown in dashed lines). In the first position, the switch mechanism 72 locks the shaft 62 (shown in cross section)

against rotation in one direction with respect to the base 50 and permits free rotation of the shaft in the opposite direction. This can be accomplished through a pawl 78 pivotally mounted to the base 50 for engagement and disengagement with teeth 80 arranged circumferentially around the shaft 62 or one or more of the drums 64. A tension spring 82 is mounted to the base 50 and the pawl 78 for alternately locking the pawl over-center in one of the first and second positions 74, 76. Manual rotation of the pawl by a user-accessible handle or knob 73 to the first position 74 causes the pawl to snap into engagement with the teeth. When it is desired to permit free rotation of the shaft with respect to the base, the pawl can be manually rotated in the opposite direction until the pawl disengages from the teeth and snaps into the second position 76.

When a wheelchair occupant desires to climb into the wheelchair after a mishap or other circumstance, the seat 17 is first lowered from the normal operating height (FIG. 1) to ground level (FIG. 2). This is accomplished by rotating the pawl 78 to the second position 76 to permit free rotation of the shaft 62 with respect to the base 50. Subsequently, the shaft 62 rotates under the weight of the seat 17, as the suspension cables 58, 60 unwind from their respective drums until the seat is at ground level. The user can then position himself or herself on the seat 17 and rotate the pawl 78 to the first position, such that the pawl engages the teeth. The telescopic torque arm 68 can then be extended and pivoted in reciprocal power and recovery strokes to wind the suspension cables around the shaft and pull the seat upward. Preferably, the torque arm 68 is pulled toward the wheelchair occupant during the power stroke to give a clockwise rotation of the shaft 62 while elevating the seat, as shown by arrow 84 in FIG. 3. Alternatively, the winch 56 can be arranged to be rotated away from the wheelchair occupant during the power stroke to give increased leverage when a backrest is present. The spring-loaded pawl allows rotation of the shaft with respect to the base 50 in the power stroke direction, and locks the shaft against rotation in the recovery stroke direction.

As shown in FIG. 4, the amount of force required to raise an occupant can be adjusted by varying the size of the drum 64, as denoted by radius B, and by varying the length of the torque arm 68, as denoted by dimension A. To decrease the amount of lifting force required during the power stroke, for example, the radius B can be reduced and the dimension A can be increased. These adjustments may depend on the person's weight and strength and can be made when the individual is fitted with the wheelchair.

After raising the seat 17 to the normal wheelchair operating height, it can then be locked to the upper frame portion. The upper frame portion can in turn be locked to the lower frame portion to secure the seat at the normal wheelchair operating height. When an occupant of the wheelchair desires to be elevated to heights greater than the normal operating height, the switch 72 is moved to the first or neutral shaft position and the locking mechanism 46 is released. The upper frame portion, including the seat, can then be moved upward with respect to the lower frame portion. Movement of the seat upward can be effected by any well-known means, such as scissor-type jacks, as disclosed in U.S. Pat. Nos. 5,520,403, 5,669,620, the disclosures of which are hereby incorporated by reference, or by pneumatic pressure, as disclosed in U.S. Pat. No. 4,993,736, the disclosure of which is hereby incorporated by reference.

Alternatively, when the upper ends of the suspension cables are mounted to the upper frame portion, the upper frame portion can be unlocked from the lower frame portion, and the seat can be unlocked from the upper frame portion. With the switch 72 in the first or neutral position, the upper frame portion can be manually lifted to the desired height and locked into place with respect to the lower frame portion. The switch 72 can then be rotated to the second position and the torque arm 68 extended. Reciprocal pivoting motion of the torque arm will then raise the seat 17 to the desired height above the normal operating height. The seat can then be locked to the upper frame portion, as previously described. To lower the seat from the elevated height, the reverse procedure is followed.

Although particular embodiments have been set forth, it will be appreciated that other means for adjusting the seat height between the elevated height, the normal operating height, and ground level can be substituted for the cable and winch assembly. For example, a worm gear arrangement or a stepper jack with a ratcheting lever arm similar to some upright automobile jacks could be used in place of the cable and winch system. However, such arrangements would tend to be more bulky and would add to the overall weight of the wheelchair. The cable and winch system is therefore preferred.

| | | | |
|---|---|---|---|
| 10 | wheelchair | 62 | shaft |
| 11 | framework | 64 | drum |
| 12 | left side frame | 66 | rod |
| 13 | wheel | 68 | torque arm |
| 14 | right side frame | 70 | slot |
| 15 | wheel | 72 | switch mechanism |
| 16 | rear lower cross member | 73 | knob |
| 17 | adjustable seat | 74 | first position |
| 18 | rear upper cross member | 76 | second position |
| 20 | front lower cross member | 78 | pawl |
| 22 | front upright | 80 | teeth |
| 24 | rear upright | 82 | spring |
| 26 | middle upright | 84 | arrow |
| 28 | upper brace | 86 | |
| 30 | lower brace | 88 | |
| 32 | front intermediate brace | 90 | |
| 34 | rear intermediate brace | 92 | |
| 36 | left side frame | 94 | |
| 38 | right side frame | 96 | |
| 40 | upper brace member | 98 | |
| 42 | front upright | 100 | |
| 44 | rear upright | 102 | |
| 46 | locking pin | 104 | |
| 48 | | 106 | |
| 50 | base | 108 | |
| 52 | cushion | 110 | |
| 54 | seat height adjustment assembly | 112 | |
| 56 | winch | 114 | |
| 58 | front cables | 116 | |
| 60 | rear cables | | |

The embodiments for which an exclusive property or privilege is claimed are defined as follows:

1. A wheelchair, for allowing an occupant to lower and raise themselves to and from a second level relative to a first operating height level, comprising:

a) a supporting frame with opposite sides;

b) two or more wheels attached to the frame;

c) a seat assembly operationally connected via adjusting means to the supporting frame between the opposite sides; and d) said adjusting means connected to the seat and supporting frame, for adjusting the height of the seat assembly relative to the supporting frame between a first operating height level associated with wheelchair operation and a second height level, wherein said adjusting means include a handle extending upwardly through an opening in a forward central portion of said seat assembly and operable in a reciprocating manner by a seated occupant using either hand individually, or both hands simultaneously.

2. The wheelchair according to claim 1, wherein the handle comprises:

a) an elongated shaft having a longitudinal axis, said shaft being connected to the seat assembly for rotation about its longitudinal axis; and b) at least one suspension cable having a first end connected to the supporting frame and a second end connected to the elongated shaft;

wherein rotation of the shaft about its longitudinal axis in one direction causes the cable to wind around the shaft to thereby raise the seat assembly, and further wherein rotation of the shaft in the opposite direction causes the cable to unwind from the shaft to thereby lower the seat assembly.

3. The wheelchair according to claim 2, wherein the at least one cable further comprises a first pair of cables, with the first end of each cable connected to one of the opposite sides of the supporting frame and the second end of each cable connected to one of the opposite ends of the elongated shaft.

4. The wheelchair according to claim 3, wherein the first pair of cables are connected to a forward portion of said supporting frame; and further comprising a second pair of cables having their first ends connected to the opposite sides of the supporting frame at a rearward portion thereof, and their second ends connected to the opposite ends of the elongated shaft.

5. The wheelchair according to claim 4, the adjusting means further comprising:

a) a torque arm connected to said shaft for rotating the shaft about its longitudinal axis in a power stroke direction; and b) a switch assembly operatively connected to said shaft and said seat assembly, said switch assembly being movable to a first position for permitting rotation of said shaft in said power stroke direction and for preventing rotation of said shaft in a direction opposite said power stroke direction.

6. The wheelchair according to claim 5, further comprising a ratcheting mechanism operatively connected between said shaft and said torque arm for locking the shaft with the torque arm in the power stroke direction and permitting rotation of said torque arm with respect to said shaft when the torque arm is rotated in a recovery direction opposite the power stroke direction.

7. The wheelchair according to claim 6, wherein the supporting frame includes a lower frame portion and an upper frame portion that is adjustable in height with respect to the lower frame portion, the seat assembly being connected to the upper frame portion for adjusting the height of the seat assembly relative to the lower frame portion between the first operating height level and a level above the second operating height level.

8. The wheelchair according to claim 7, wherein the upper end of each cable is attached to the upper frame portion.

9. The wheelchair according to claim 8, wherein the upper frame portion is telescopically received in the lower frame portion.

10. The wheelchair according to claim 9, further comprising a locking mechanism connected to at least one of the upper and lower frame portions and being engageable with the other of the upper and lower frame portions for locking the upper and lower frame portions together at any number of seat assembly heights.

11. The wheelchair according to claim 5, wherein the switch assembly is movable to a second position for permitting free rotation of said shaft in said opposite direction.

12. The wheelchair according to claim 7, wherein the upper frame portion is telescopically received in the lower frame portion.

13. The wheelchair according to claim 2, further comprising:

a torque arm connected to said shaft for rotating the shaft about its longitudinal axis in a power stroke direction; and a switch assembly operatively connected to said shaft and said seat assembly for permitting rotation of said shaft in said power stroke direction and for preventing rotation of said shaft in a direction opposite said power stroke direction.

14. The wheelchair according to claim 3, further comprising a ratcheting mechanism operatively connected between said shaft and said torque arm for locking the shaft with the torque arm in the power stroke direction and permitting rotation of said torque arm with respect to said shaft when the torque arm is rotated in a recovery direction opposite to the power stroke direction.

15. The wheelchair according to claim 1, wherein the supporting frame includes a lower frame portion and an upper frame portion that is adjustable in height with respect to the lower frame portion, the seat assembly being connected to the upper frame portion for adjusting the height of the seat assembly relative to the lower frame portion between the first operating height level and a level above the second operating height level.

16. A wheelchair, for allowing an occupant to lower and raise themselves to and from a ground level relative to a first operating height level, comprising:

a) a supporting frame with opposite sides;

b) two or more wheels attached to the frame;

c) a seat assembly operationally connected via adjusting means to the supporting frame between the opposite sides;

d) said adjusting means, operable by a seated occupant using either hand individually, or both hands simultaneously, coupled to the supporting frame and seat assembly, for adjusting the height of the seat assembly relative to the supporting frame between a first operating height of the seat assembly relative to the supporting frame between the first operating height and a lower level, said adjusting means including:

d1) an elongated shaft having a longitudinal axis, said elongated shaft being connected to the seat assembly for rotation about its longitudinal axis;

d2) at least one suspension cable having a first end connected to the supporting frame and a second end connected to the elongated shaft;

d3) a torque arm operable in a reciprocating manner by a seated occupant, the torque arm extending upwardly through an opening in a forward central portion of the seat assembly and being connected to said elongated shaft for rotating the shaft about its longitudinal axis in a power stroke direction; and d4) switch means, connected to said elongated shaft and said seat assembly, for switching to a first position that permits rotation of said elongated shaft in said power stroke direction and that prevents rotation of said elongated shaft in a direction opposite to said power stroke direction, and for switching to a second position that permits free rotation of said elongated shaft in said power stroke direction and said opposite direction;

wherein rotation of the elongated shaft about its longitudinal axis by the torque arm in said power stroke direction causes the suspension cable to wind around the shaft to thereby raise the seat assembly, and further wherein rotation of the elongated shaft in the opposite direction causes the suspension cable to unwind from the elongated shaft to thereby lower the seat assembly.

17. A wheelchair having an adjustable seat assembly allowing a wheelchair user to lower and raise the seat assembly, said wheelchair comprising:

a) a supporting frame with opposite sides, said supporting frame having an upper brace and a lower brace;

b) two or more wheels attached to the supporting frame and mounted between said upper brace and said lower brace;

c) the seat assembly operationally connected via a non-inflatable adjustment device to the supporting frame between the opposite sides; and d) said adjustment device connected to the seat assembly and movably attached to the seat assembly, for adjusting the height of the seat assembly throughout a range of motion; and e) wherein said range of motion has a lower limit, said lower limit defined by the surface upon which the two or more wheels rest.

18. The wheelchair of claim 17, wherein the seat assembly can be lowered to contact the ground.

19. The wheelchair of claim 17, wherein the seat assembly can be lowered to the ground and subsequently entered by a user.

* * * * *

UNITED STATES PATENT AND TRADEMARK OFFICE

CERTIFICATE OF CORRECTION

PATENT NO. : 6,467,785 B2
DATED : October 22, 2002
INVENTOR(S) : Toppses

It is certified that error appears in the above-identified patent and that said Letters Patent is hereby corrected as shown below:

Title page,
Item [75], Inventor, please delete "Tony Toppses" and insert -- Anthony N. Toppses --

Signed and Sealed this

Twenty-eighth Day of January, 2003

JAMES E. ROGAN
*Director of the United States Patent and Trademark Office*